United States Patent [19]

Bardos

[11] Patent Number: 4,875,631

[45] Date of Patent: Oct. 24, 1989

[54] WEAR PROTECTION CHIPPER DISC

[75] Inventor: Gary M. Bardos, Mt. Pleasant, Mich.

[73] Assignee: Recycling Systems, Inc., Winn, Mich.

[21] Appl. No.: 300,049

[22] Filed: Jan. 23, 1989

[51] Int. Cl.[4] ..... B27C 7/12

[52] U.S. Cl. ..... 241/92; 144/162 R; 144/176; 241/197; 241/296

[58] Field of Search ..... 241/91, 92, 296, 298, 241/197; 144/162 R, 176

[56] References Cited

U.S. PATENT DOCUMENTS 3,542,302 11/1970 Salzmann, Jr. ..... 241/92 X 4,047,670 9/1977 Svensson ..... 144/176 X

*Primary Examiner*—W. Donald Bray

*Attorney, Agent, or Firm*—Price, Heneveld, Cooper, DeWitt & Litton

[57] ABSTRACT

A wood chipper is disclosed comprising a large rotational disc with a pattern of blade mounting pockets, usually in a spiral, on the front face, such that mounted chipping knives project diagonally from the face of the disc at an acute angle to the disc, with chip passage slots extending through the disc at these pockets; and hardened elongated ridges protruding from and integral with the disc face, offset from the pockets and slots toward the direction of rotation, these ridges being diagonally oriented relative to a radius of the disc.

14 Claims, 2 Drawing Sheets

WEAR PROTECTION CHIPPER DISC

BACKGROUND OF THE INVENTION

This invention relates to wood chipping machinery, and is particularly useful for chipping disintegrators for stumps and other wood debris as disclosed in U.S. Pat. Nos. 4,736,781 and 4,771,953.

As explained in the above patents, the problem of disposal of certain types of materials such as stumps, wood debris from old lumber, limbs, roots, pallets and other such items is becoming more severe. Those landfill businesses that are still operational increasingly will not accept these materials. The alternative of burning them is often outlawed. Leaving these items on site is aesthetically unappealing and usually contrary to zoning regulations. Consequently, machines of the type in the above patents have proven highly desirable for reducing large items such as stumps, etc. to chips which have definite utility and are disposable.

Because such items do not typically comprise just clean wood, e.g. stumps and limbs have sand, stones and the like clinging to them, discarded pallets have nails, clips and other metal fasteners therein, and old lumber as from demolished buildings has metal spikes, nails, electrical wiring and the like clinging thereto and embedded therein, the chipper is subjected to rigorous conditions. One item subjected to particular wear is each of the several chipping knives. Another significant wear area, however, has been found to be on the disc itself, just upstream of the slot adjacent each knife mounting pocket and through which the chips pass as they are formed by the action of the knife with the anvil.

As the knives wear, they can be reversed and/or rotated to expose sharp edges, and ultimately replaced. Too frequent replacement involves considerable added expense. Chipping with dulled and broken knives, however, requires greatly increased energy input, causes expensive heat generation at the wood, and slows production drastically. Therefore, knives are frequently replaced even though expensive. It would be greatly advantageous to delay wear of the knives. As to disc wear upstream of the knife pockets, this results in poor chipping action, greater wear of the knives and holders, and even destruction of the knife holders and mounting pockets. It ultimately necessitates extensive repair to or replacement of the large, heavy and expensive disc.

SUMMARY OF THE INVENTION

The present invention effects substantial wear reduction of the chipping knives and also of the disc of wood chippers, especially those for chipping stumps, old lumber, used pallets, and other materials which frequently include contaminating sand, stones and metal components, such chippers being disclosed in U.S. Pat. No. 4,736,781 titled STUMP DISINTEGRATOR, issued Apr. 12, 1988, and U.S. Pat. No. 4,771,953 titled RETRACTABLE ANVIL CHIPPER, issued Sept. 20, 1988, both incorporated by reference herein. These results are achieved by employing in the combination a chipper disc which has special hardened protrusions preferably in the nature of ridges protruding from the face of the disc and located circumferentially offset from the knife mounting pockets and the chip passage slots in the direction of disc rotation. Each protrusion is preferably an elongated ridge oriented diagonally relative to a radius of the disc and relative to the knife and pocket. On a chipping disc having the knife pockets and the slots in a special pattern, ridges are in a similar pattern, preferably two or more ridges per slot. Each protrusion is of a material considerably harder than the disc, protrudes axially a controlled amount from the face of the disc relative to the blade extension, and made integral with the disc normally by welding.

DESCRIPTION OF THE PREFERRED EMBODIMENT

Figure 1:
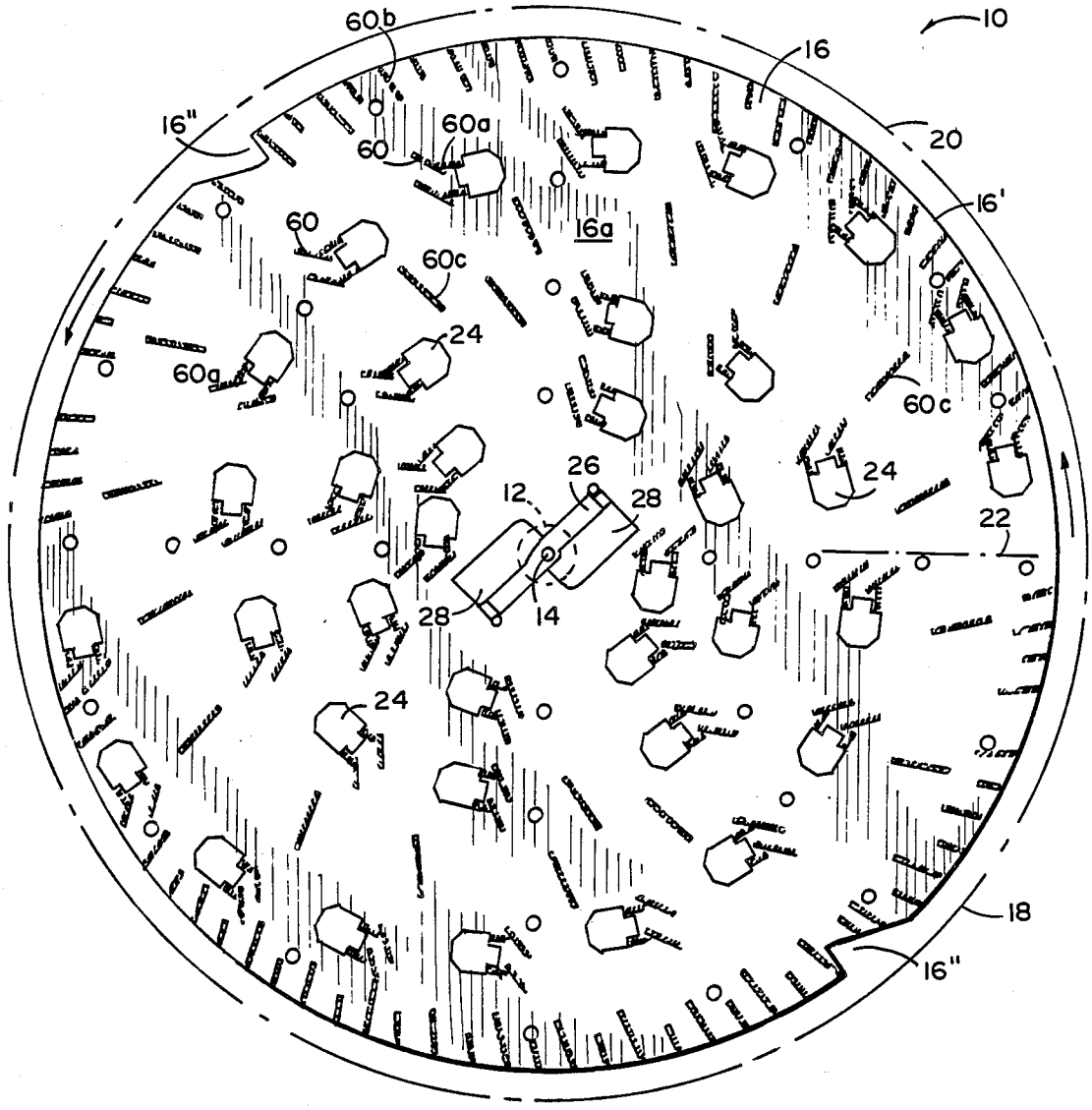
FIG. 1 is an elevational view of an embodiment of the novel chipper assembly.

Referring now specifically to the drawings, a preferred embodiment of the inventive combination is set forth. To prevent obscuring the invention, certain of the components known previously are represented by phantom lines. The particular embodiment depicted herein is primarily intended to be incorporated into an apparatus of the type described in detail in issued U.S. Pat. No. 4,736,781, entitled STUMP DISINTEGRATOR. Thus, the chipper assembly 10 is mounted on a frame (not shown herein) which may, if desired, comprise the bed of a truck trailer. Connected to the chipper assembly is a drive motor which is normally an internal combustion engine, but may alternatively be an electric motor, a hydraulic motor or the like (not shown). This drive motor is operably connected to a central axle 12 of the disc (shown in phantom), on an axis 14 coaxial with the axis of chipper disc 16. The axle preferably extends only to the rear of disc 16 to which it is affixed. Adjacent to and beneath disc 16 which is depicted vertical in orientation is a support surface 18 for supporting material to be chipped. This support may comprise a trough (here represented by a phantom line) of the type in the above identified patent, or some alternatively configurated surface. A ram or the equivalent (not shown), as like that in the above referenced patents, forcefully advances the material on support 18 against the front face **16*a* of the rotating disc. Extending over the top portions of disc 16 is a housing 20 (here represented by a phantom line) which preferably comprises an axially extending cowl as in the above patents, or the equivalent. An anvil 22** (here represented by a phantom line) projects radially of the disc closely adjacent its front face and is preferably retractable as set forth in U.S. Pat. No. 4,771,953.

Figure 3:
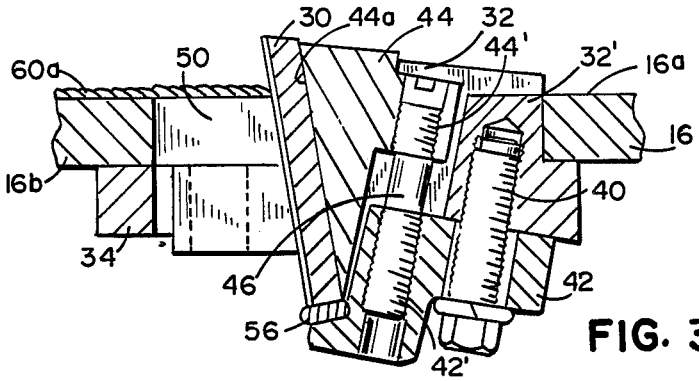
FIG. 3 is a fragmentary sectional view taken on plane III—III of FIG. 2.
Figure 2:
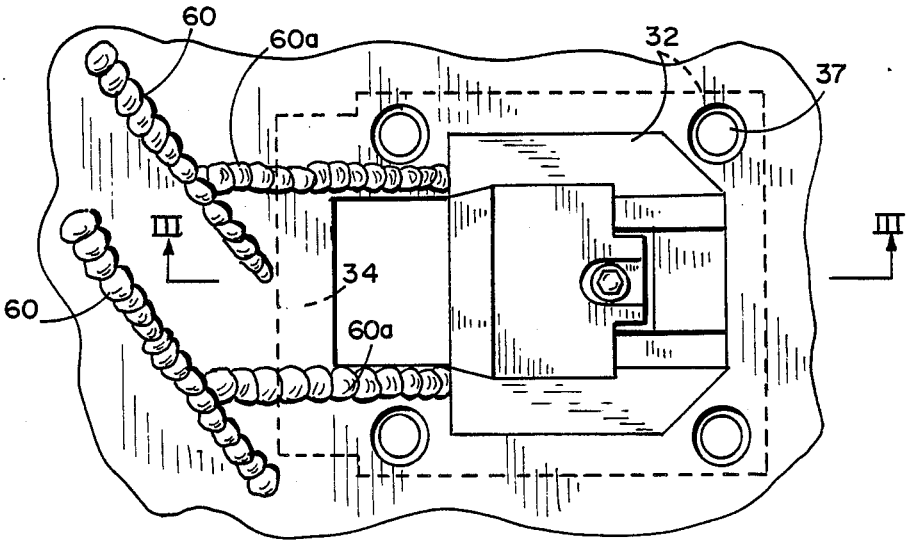
FIG. 2 is a somewhat enlarged fragmentary elevational view of one knife pocket, knife assembly and wear inhibiting ridges in their relationship thereto.
Figure 4:
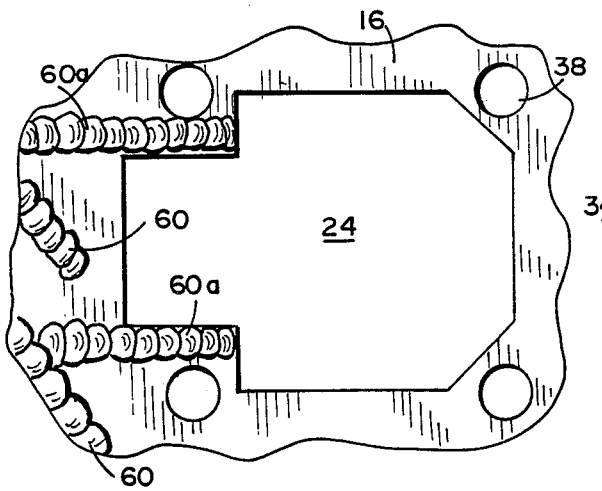
FIG. 4 is a fragmentary elevational view of the portion of the disc in FIG. 2 with the knife and knife holder assembly removed.
Figure 5:
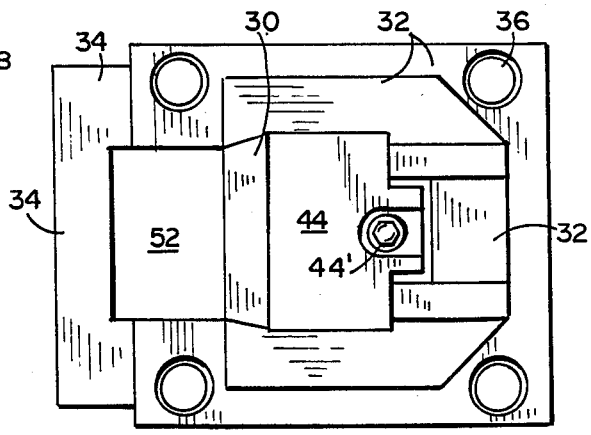
FIG. 5 is an elevational view of the knife and knife holder assembly as removed.

The power motor means rotationally drives axle 12 to cause disc 16 to rotate in one direction indicated by the arrows in FIGS. 1 and 3. This disc 16 has a periphery 16' basically circular in configuration except for a pair of notched kicker cutouts 16''. The purpose of these kickers is to prevent material from jamming between the disc periphery and underlying support 18 or overlying housing 20. This disc is basically cylindrical, having a thickness of several inches and a diameter of several feet. Disc 16 has a front face 16*a*, i.e. that face in FIG. 1 oriented toward the reader and normal to axis 14. The material to be chipped is fed on support 18 toward this face. A series of knife mounting pockets are provided in the disc. These pockets comprise openings 24 which extend from the front face 16*a* through the disc to the rear face 16*b* and receive knife holder assemblies. A portion of each opening is left open, i.e. unblocked, to form a chip passage slot. These components will now be described more specifically with reference to FIGS. 2–5.

These openings 24 (FIG. 4) in disc 16 are shown in a pattern in FIG. 1 on the disc, such being preferably a spiral pattern. The specific version of the spiral pattern depicted in FIG. 1 is a double spiral, each portion of a spiral starting at the outer peripheral edge opposite the other spiral and terminating adjacent the central portion of the disc. The smaller width portion of the generally T-shaped openings 24 is the leading end thereof, this smaller portion serving as the through slot through which the chips pass when the knives and holders are mounted. At the center of the disc is preferably mounted a transverse drill type planer cutter 26. A pair of adjacent special openings 28 is provided at this cutter. This cutter prevents stagnation of material pieces at the disc center during operation.

Each knife holder assembly is similar to that depicted in FIG. 11 of the above identified U.S. Pat. No. 4,736,781 except for two particular modifications, one being the support at the base of the blade, and the other being a reinforcing cross member between the forward ends of the outer holder body as explained hereinafter.

Each of the holder assemblies mounts a knife which is steel or carbide. This knife is at an acute angle to the plane of the disc front face, projecting axially beyond the disc front face and tilted with the outer edge toward the direction of rotation of the disc and thus the direction of advancement of the knife. Each knife travels in a circular circumferential path during operation.

The knife 30 at each pocket preferably has a dovetail fit within its holder, having two tapered lateral side edge portions (see FIG. 2) fitting within like configurated receiving slots formed into the inside faces of the opposite legs of a generally U-shaped or rectangular shaped outer holder body 32. The smaller width edge of the knife is the leading edge (see FIG. 2). The forward ends of the two legs of this holder are shown connected by a reinforcing cross tie member 34. Holder body 32 has a plurality of four fastener receiving orifices 36 at its four corners to enable it to be mounted by bolt fasteners 37 to threaded orifices 38 (FIG. 4) extending into and through disc 16 from the rear face thereof. Holder 32 has a central portion 32' which fits down into the chipper disc opening serving as a pocket when the body is so secured. Connected to this central portion 32' by a threaded fastener bolt 40 is an inner holder nut member 42. This nut member includes a threaded socket 42' for purposes to be explained. Engaging the back face of knife 30 is the tapered front face 44*a* of a wedge member 44. This wedge member also has a threaded socket 44' aligned with socket 42' in nut 42. A differential threaded fastener 46 having left-hand threads on one end and right-hand threads on the opposite end threadably engages sockets 44' and 42'. Thus, rotation of the fastener as by an Allen wrench will pull wedge 44 down into holder body 32 and thereby bind knife 30 into its slots in holder 32. The rear face of wedge 44 engages a cooperatively oriented wedge face of body 32.

This entire knife and holder assembly can be preassembled for rapid insertion as a unit into a disc pocket, or removal therefrom. When so inserted, there remains a through slot 50 circumferentially ahead, i.e. in the direction of rotation, of knife 30 in the disc, as well as a corresponding opening 52 (FIG. 5) in the holder at the rear face of the disc, to allow chips as they are formed to freely pass through the disc and past the rear face thereof. Mounted at the rear face 16*b* of the disc is a plurality of radially oriented fan blades (not shown) like those in U.S. Pat. No. 4,736,781 to throw the chips radially outwardly through a tangential discharge spout (not shown) like that in U.S. Pat. No. 4,771,953 into a receiver.

Combined with these above described components is the special wear inhibiting structure illustrated as axially protruding hardened deflector protrusions shown as elongated ridges 60, 60*a*, 60*b* and 60*c* on the disc front face. A substantial number of the ridges, i.e. pairs of ridges 60 and 60*a*, are adjacent the knife pockets and holder assemblies. Others, i.e. ridges 60*b*, are optionally adjacent the peripheral portions of the front face, and some, i.e. ridges 60*c*, are located between the knife pockets. These ridges project axially from front face 16*a* a controlled amount. They are preferably formed by arc welding successive deposits of a chromium steel alloy or the equivalent onto the disc front face. Ridges 60*b* at the outer periphery and ridges 60*c* between the pockets are oriented at an acute angle relative to radii of the disc, diagonally such that the outer ends of the ridges are more toward the direction of rotation of the disc than the radially inner ends. In the preferred illustrated form of the ridges, such are composed of integrally interconnected, successively applied deposits of weldment fused to the disc face and to each other to result in a continuous deposit which may have an outermost surface of nearly the same dimension of projection from the disc face, or a series of hillock-like portions. Conceivably, but not preferably, at least some of the ridges could be formed of noninterconnected protrusions in a row or equivalent pattern.

It is important to locate ridges circumferentially forwardly offset from the pockets toward the direction of rotation of the disc and knives. The optimum orientation of these ridges has been found to be diagonal relative to the respective knife edge, relative to the centerline of the respective pocket, and to radii of the disc, at an acute angle to these of about 45 degrees. The combined projected radial extent of the deflector ridges is at least equal to the width of the knife, and preferably greater. In the circumferential path of blade movement, the ridges overlap each other. Typically two such diagonal ridges have been found to be adequate for each knife. It is desired to have ridges as close as possible to slots 50 and knives 30. Because it is difficult to diagonally orient ridges which are very close to the slot and pocket, they are formed at 60*a* generally normal to the knife, i.e. parallel to slot 50 side walls.

The material forming the protrusions is of a hardness substantially greater than that of the steel disc, sufficiently greater to inhibit wear of the disc at the slots and to protect the knives against excessive damage and wear. This can be accomplished by arc welding a chromium containing ferrous material having a hardness of about 60–64 Rockwell C, or an equivalent thereof as deposits fused to the steel disc. The material presently considered best is a ferrous material containing chromium, magnesium, silicon and carbon and having a Rockwell C hardness in the range of 60–64, applied by welding successive deposits from a wire in a single pass onto the disc face, preferably by an automatic welding apparatus.

It has been found through extensive experimentation that the life of the disc is greatly extended and the useful life of the knives before they are dull or smashed from sand, rocks, chunks of steel and the like is greatly extended by this invention.

The knives typically extend from the face of disc 16 approximately one-half inch. As they wear and are reset, the extension may vary somewhat, although an insert 56 (FIG. 3) of selected thickness is placed beneath each knife to cause it to extend beyond the outer surface of wedge 44. The hardened ridges project from the disc face a fraction of this knife extension, preferably about 25 percent thereof, the ridge height thus typically projecting about one-eighth inch from the face of the disc. Although the ridge height compared to the knife height can vary somewhat, if the ridge height is substantially less than this, its effectiveness to inhibit knife wear rapidly diminishes. If it is substantially more, i.e. too great a percentage of the knife extension, the deflector ridges render the knife inefficient. The optimum typically is as noted, about 25 percent of the knife height extension.

In operation of this apparatus, stumps, pallets, old lumber, tree chunks and the like are loaded on support 18 as by an attached or unattached loader, and then advanced by a ram against front face 16*a* of disc 16 which is rotationally driven in the direction indicated by arrows. The tilted knives impart a pulling force on the material toward the disc as the chipping takes place. The hardened deflector ridges inhibit undue wear of the knives and holders and of the disc upstream of the pockets. They also tend to inhibit wear adjacent the outer disc periphery and in the spaces between the knives. The overall effect is to considerably lengthen the life of the replaceable knives, curtail damage to the knife holders, and extend the disc life.

Conceivably, variations could be made in the preferred embodiment set forth above as exemplary of the invention. Thus, it is intended that the invention is to be limited only by the scope of the claims attached hereto, and the reasonable equivalents to that defined therein.

The embodiments of the invention in which an exclusive property or privilege is claimed are defined as follows:

1. A chipper for wood material such as stumps, chunks of wood, roots, limbs, old lumber and the like, comprising:

a rotational chipping disc having a periphery and an axis of rotation and adapted to be driven in one rotational direction;

a support for material to be advanced to said disc;

said rotational disc having a front face normal to said axis, and a series of knife mounting pockets in said disc for mounting knives to extend axially from said front face, diagonally at an acute angle toward said direction of disc rotation, and having chip passage slots extending through said disc adjacent said pockets;

hardened deflector protrusions on said disc front face, projecting axially therefrom, and offset from said pockets toward said direction of rotation, and said protrusions being of a material having a hardness sufficiently greater than that of said disc that said protrusions inhibit wear of said disc at said chip passage slots.

2. The chipper of claim 1 wherein said protrusions are elongated ridges, and are oriented diagonally relative to said pockets.

3. The chipper of claim 2 wherein said ridges are oriented diagonally toward said disc periphery, and have radially inner ends and radially outer ends, said radially outer ends of said ridges projecting further toward said direction of rotation than said radially inner ends of said ridges.

4. The chipper of claim 2 wherein said ridges are oriented at an angle of about 45 degrees from the radius of said disc.

5. The chipper of claim 3 wherein said ridges are oriented at an angle of about 45 degrees from the radius of said disc.

6. The chipper of claim 1 wherein said knife mounting pockets are in a pattern over said disc front face; and said protrusions are also in a pattern, are integral with said disc, and project from said disc front face a fraction of the extension of said knives.

7. The chipper of claim 6 wherein said knife mounting pockets are in a spiral pattern on said disc and a substantial share of said deflector protrusions are adjacent said pockets.

8. The chipper of claim 6 wherein more than one of said protrusions is adjacent individual ones of said pockets.

9. The chipper of claim 8 wherein a pair of ridges is adjacent individual ones of said pockets.

10. The chipper of claim 5 wherein said ridges are oriented diagonally toward said disc periphery, and have radially inner ends and radially outer ends, said radially outer ends of said ridges projecting further toward said direction of rotation than said radially inner ends of said ridges.

11. The chipper in claim 8 wherein said ridges have a projected radial extent at least the width of said knives.

12. The chipper in claim 1 wherein said deflector protrusions project from said disc front face a fraction of the amount that said knives extend from said front face.

13. The chipper in claim 12 wherein said protrusions project from said front face about 25 percent of the amount said knives extend from said front face.

14. The chipper in claim 3 wherein a substantial share of said deflector ridges are adjacent said pockets in the circumferential direction of rotation, and other of said ridges are adjacent the disc periphery.

* * * * *